US006178249B1

(12) United States Patent
Hietanen et al.

(10) Patent No.: US 6,178,249 B1
(45) Date of Patent: Jan. 23, 2001

(54) ATTACHMENT OF A MICROMECHANICAL MICROPHONE

(75) Inventors: Jarmo Hietanen, Tampere; Outi Rusanen, Oulu, both of (FI)

(73) Assignee: Nokia Mobile Phones Limited, Espoo (FI)

( * ) Notice: Under 35 U.S.C. 154(b), the term of this patent shall be extended for 0 days.

(21) Appl. No.: 09/335,419

(22) Filed: Jun. 17, 1999

(30) Foreign Application Priority Data

Jun. 18, 1998 (FI) ..... 981413

(51) Int. Cl.[7] ..... H04R 25/00
(52) U.S. Cl. ..... 381/174; 381/173; 367/181
(58) Field of Search ..... 381/173, 174, 381/190, 191, 356, 358, 361; 367/181, 188; 307/400

(56) References Cited

U.S. PATENT DOCUMENTS

| | | | | |
|---|---|---|---|---|
| 3,588,382 | * | 6/1971 | Reedyk et al. | 381/174 |
| 4,626,729 | * | 12/1986 | Lewiner et al. | 381/174 |
| 4,922,471 | | 5/1990 | Kuehnel | 367/181 |
| 5,255,246 | * | 10/1993 | Van Halteren | 381/174 |
| 5,313,661 | | 5/1994 | Malmi et al. | 455/232.1 |
| 5,452,268 | * | 9/1995 | Bernstein | 381/174 |
| 5,600,610 | * | 2/1997 | Hill et al. | 381/174 |
| 5,677,965 | | 10/1997 | Moret et al. | 381/191 |
| 5,742,733 | | 4/1998 | Jarvinen | 395/2.29 |
| 5,836,790 | | 11/1998 | Barnett | 439/620 |
| 5,856,914 | | 1/1999 | O'Boyle | 361/761 |
| 6,111,966 | * | 8/2000 | Staat et al. | 381/174 |

FOREIGN PATENT DOCUMENTS

| | | |
|---|---|---|
| 445 701 | 7/1986 | (SE) . |
| WO 95/31082 | 11/1995 | (WO) . |
| WO 96/05711 | 2/1996 | (WO) . |
| WO 97/39464 | 10/1997 | (WO) . |

* cited by examiner

*Primary Examiner*—Curtis A. Kuntz
*Assistant Examiner*—Suhan Ni
(74) *Attorney, Agent, or Firm*—Perrman & Green, LLP

(57) ABSTRACT

The invention relates to a method for attaching a micromechanical microphone (1) to be used in connection with a mobile station to a substrate (2), in which a diaphragm (4) and back electrode (6) for the microphone (1) are placed within a distance of each other, wherein an air gap (7) is formed between the diaphragm (4) and the back electrode (6). An insulation ring (12) is placed between the microphone (1) and the substrate, wherein the back electrode (6), the substrate (2) and the insulation ring (12) define a back chamber (13). The microphone (1) is attached to the substrate (2) with fixing means (11*a*, 11*b*), wherein the volume (Vb) of the back chamber (13) is adjusted by adjusting the height of the fixing means (11*a*, 11*b*).

10 Claims, 6 Drawing Sheets

ATTACHMENT OF A MICROMECHANICAL MICROPHONE

BACKGROUND OF THE INVENTION

1. Field of the Invention

Figure 1:
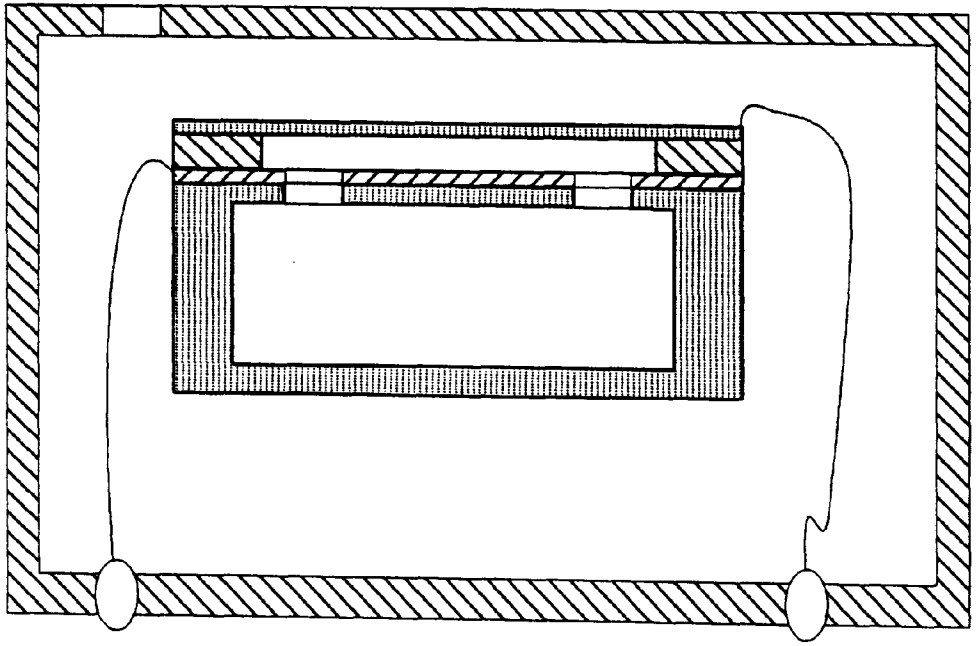

The present invention relates to a method according to the preamble of the appended claim 1 for attaching a micromechanical microphone. The invention relates also to a micromechanical microphone attached according to the method.

2. Description of the Related Art

The efficacy of receiving acoustic signals is primarily determined by the conversion performance of a microfone between acoustic and e.g. electrical energy. The distortion and frequency response of the microphone is, in turn, significant with respect to sound quality. In several audio applications, the aim is to optimize for instance microphones in such a way that sound quality, costs, the size of the device, producibility and other productive aspects result in an acceptable device unit.

Frequently for instance microphones place restrictions on the application. One impediment, for example, for reducing the dimensions of mobile phones is the physical size of the microphone. The microphones currently known are structurally separate, encapsulated components which are coupled by means of connector pins or the like, arranged in the housing of the microphone, either directly to a circuit board or electrically to other circuitry by means of separate connection wires or springs. In microphones, the signal conversion is based on a transformation, i.e. more generally, on a change in the mutual geometry between two transducer means, such as a diaphragm and a back plate. In microphones, the transformation is produced with sound. At least one transducer means is elastically transformable, e.g. flexible or compressible. Consequently, the microphones are composed of several discrete components, while the internal integration level of the component remains fairly low.

It is possible to divide microphones into different types according to the operational principle. The microphone types most commonly used in acoustics are based on an electrostatic or electromagnetic (a moving coil or magnet) principle, or to the piezoelectric phenomenon.

In electrostatic microphones, for example two, advantageously planar diaphragms or plates, placed in the vicinity of each other and forming a capacitor, can be used as transducer means. The first diaphragm is typically elastic or flexible, and the second diaphragm is made stationary. The transformation is based on the alteration in the capacitance between the transducer means, which is an outcome of a change in the distance between the diaphragms. The force between the diaphragms depends, for instance, on electric charges present in the diaphragms, and on other mechanical structures.

In microphones, sound generates deformations in an acoustic means, which deformations are coupled into an electric signal according to the physical principles presented above. For example, a capacitor microphone is provided with an electrically conductive diaphragm, which vibrates with the sound. An electrically conductive back plate is typically placed parallel to the diaphragm, wherein the diaphragm and the back plate form a capacitor which has a capacitance value defined by its geometry. Because the deformation produced by sound, i.e. a deflection in the diaphragm, alters the distance between the diaphragm and the back plate, the capacitance of the capacitor changes accordingly.

To detect an alteration in the capacitance, an electric potential difference is arranged between the diaphragm and the back plate, and the diaphragm and the back plate are coupled to an amplifier circuit, for example to the gate of a JFET transistor in a way known as such. The potential difference can be formed, for example, with a bias voltage, wherein a direct voltage is conducted between the diaphragm and the back plate. Instead of the bias voltage, it is also possible to use a prepolarized electret material combined either to the back plate and/or to the diaphragm, wherein the microphone is called an electret microphone. Consequently, the change in the capacitance creates a varying voltage signal which can be amplified in a conventional amplifier. Thus, in this microphone type, the first transducer means is the diaphragm and the second transducer means consists of the back plate.

In the piezoelectric phenomenon, the stress state of an object releases charges from the material and, inversely, charges conducted into the object generate stress states. In such a microphone, the first transducer means is an object in which the piezoelectric phenomenon occurs. The substrate of the first means, with respect to which the first means is deformed, can be used as the second transducer means. The force between the transducer means depends, for example, on the material used, the dimensions, the voltage generated, and on other mechanical structures.

By means of micromechanics, it is possible to produce small-sized components, such as microphones and pressure transducers. In micromechanical components, silicon is typically used as a substrate. The production takes place either subtractively or additively. In subtractive production, silicon is chemically discharged from predetermined points on a silicon wafer, wherein a desired micromechanical component is produced. In additive production, a so-called additive method is used, wherein desired layers are added on a suitable substrate. In the production of micromehanical components, it is possible to use both of these methods. In micromechanical components, the thickness of the layers is typically in the order of micrometers. In addition to various silicon compounds, it is possible to utilize for instance metallization to produce e.g. conductors.

A micromechanical microphone typically comprises a diaphragm and a back electrode, between which there is an air gap whose thickness is typically in the order of 1 $\mu$m. Furthermore, the micromechanical microphone typically comprises a back chamber, with which it is possible to affect, for instance, the frequency response of the micromechanical microphone. The height and volume of this back chamber is typically many times the air gap between the diaphragm and the back electrode respective the volume between them. FIG. 1 presents the structure of such a micromechanical microphone of prior art in a reduced cross-section.

In micromechanical microphones, the back electrode is typically perforated, wherein in a stable situation, the pressure on both sides of the back electrode is substantially equal. Furthermore, a venting system for pressure balancing is typically arranged from the back chamber or directly through the pressurized diaphragm, wherein the pressure of the back chamber will be substantially equal to the stable air pressure prevalent in the environment of the micromechanical microphone.

The volume of the back chamber, i.e. the so-called back volume is a substantial factor in microphone design when setting the acoustic properties of the microphone. The acoustic properties desired for the microphone depend, for instance, on the use of the microphone. For example in telephone use, a smaller band-width will be sufficient than in microphones intended for HiFi applications. Another criterion for microphone design is the sensitivity of the microphone, i.e. the smallest pressure fluctuation the microphone reacts to. A further criterion is the noise of the microphone itself, which in micromechanical microphones is caused by thermal vibrations in the diaphragm and thermal noise from both conductors and semiconductors.

U.S. Pat. No. 4,922,471 discloses another micromechanical microphone. This microphone is formed of two silicon chips, provided with a diaphragm in between them. The back electrode is formed as an inflexible structure, and at the same time it forms the back chamber. Furthermore, the back electrode is provided with a FET transistor, whereby the microphone signal is amplified.

Moreover, according to prior art, micromechanical microphones are encapsulated to facilitate the handling of microphones in connection with storage, transportation and attachment to the end product. The connection leads of the microphone are connected to connector pins formed in the housing, or they are formed as separate conductors through the housing. One reason for the encapsulation of the micromechanical microphone is the fact that this is a better way to ensure that the geometry between different functional parts of the micromechanical microphone remains as good as possible all the way to the end product.

Micromechanical microphones of prior art which comprise housings and other structures are, however, relatively large compared with the micromechanical microphone as such. This is due to, for instance, the fact that in the end product the micromechanical microphone is, first of all, inside a housing of its own, and further, this encapsulated microphone is inside the housing of the end product. Furthermore, the the size of the micromechanical microphone is increased by the fact that the micromechanical microphone is typically electrically coupled to the rest of the electronics of the device by means of leads.

One drawback complicating the use of acoustic transducers of prior art is the space they require due to, for instance, the fact that the first transducer means and the second transducer means have to be encapsulated, and the transducer has to be constructed separately to be mechanically rigid. Thus, the space required by the housing increases the need of space for the acoustic transducer. These factors restrict especially the reduction in the size of portable devices. Furthermore, encapsulation raises the price of acoustic transducers.

SUMMARY OF THE INVENTION

One purpose of the present invention is to provide an attachment of a micromechanical microphone to an electronic device, especially to a wireless communication device, without a need to provide a separate housing around the microphone. The method according to the present invention is characterized in what will be presented in the characterizing part of the appended claim 1. Furthermore, the micromechanical microphone according to the present invention is characterized in what will be presented in the characterizing part of the appended claim 5. The invention is based on the idea that the micromechanical microphone is attached onto its substrate by using a so-called flip-chip technology, wherein the back volume and thereby the acoustic features of the micromechanical microphone can be controlled by adjusting the size of the fixing means used in the attachment.

With the present invention, considerable advantages are achieved when compared with methods and micromechanical microphones of prior art. Applying the method according to the invention, a separate housing is not required in connection with a micromechanical microphone, but the housing structure of the electronic device itself is utilized as the housing. In the attachment according to the method, it is possible to control the features of the micromechanical microphone for instance because the back volume can be adjusted when attaching the micromechanical microphone. With the method according to the invention, it is also possible to reduce the size of the electronic device because the micromechanical microphone according to the invention does not require a separate housing, and, on the other hand, separate connection leads or strings are not necessary. A further advantage of the attachment method according to the invention is that possible distortions and other deformations caused by heat in the substrate or in the housing of the device are not substantially transmitted to the microphone structure and therefore do not affect the acoustic or electric features of the microphone, ensuring, however, a firm attachment. The housing of the device also functions as a dust cover. Furthermore, in the structure according to the invention, pressure losses are smaller than in encapsulated microphones of prior art, since in the housing of the device, the sound reaches first the pressurized diaphragm of the microphone.

DESCRIPTION OF THE INVENTION DRAWING

Figure 2:
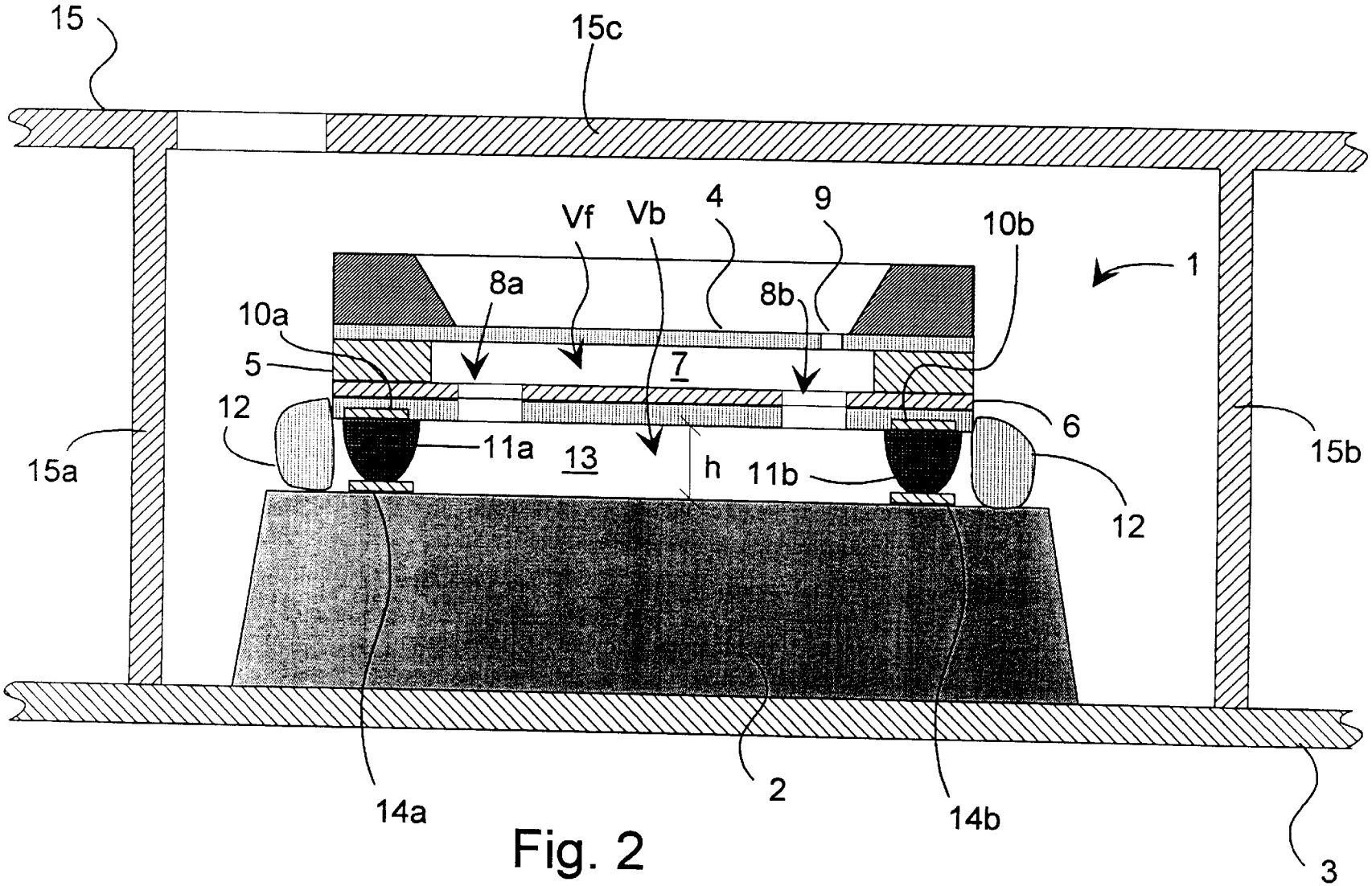
Figure 3A:
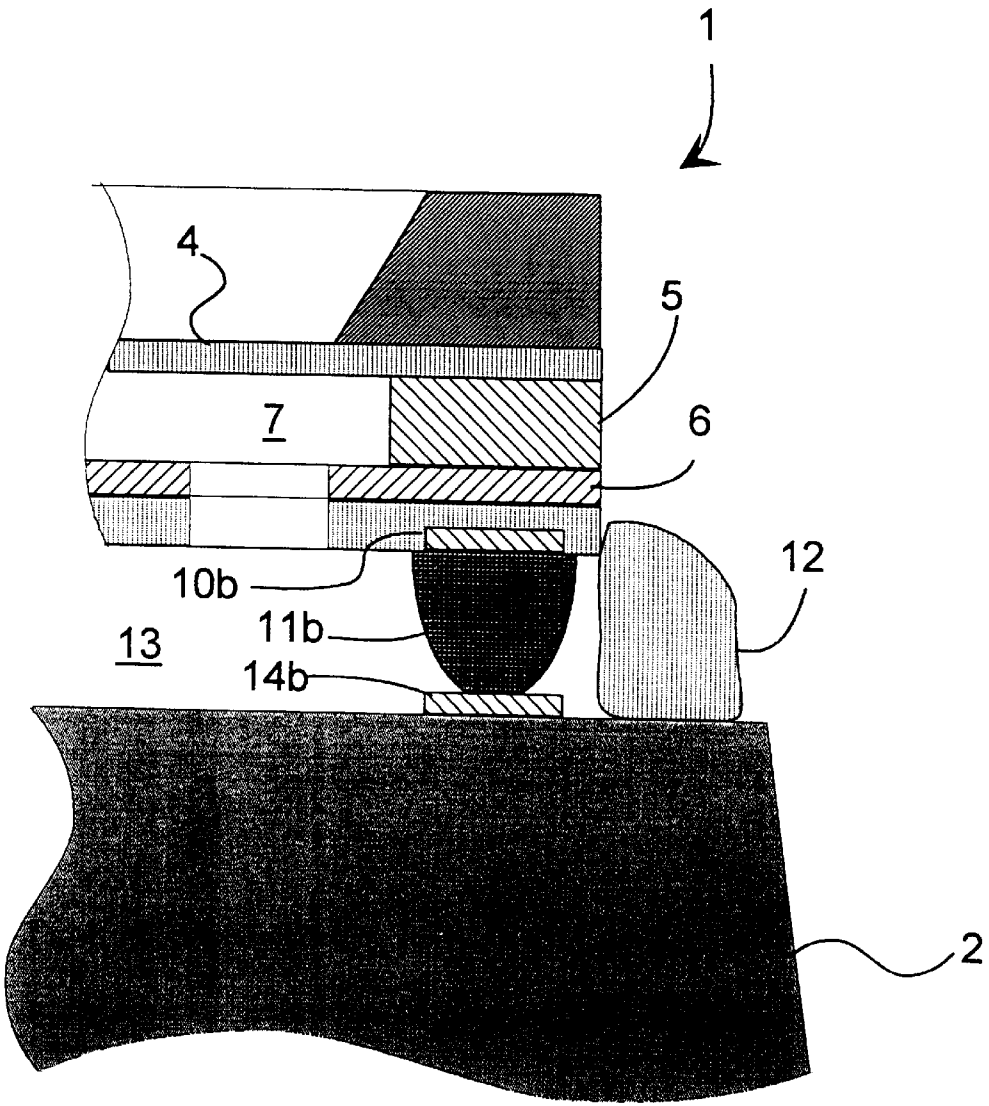
Figure 3B:
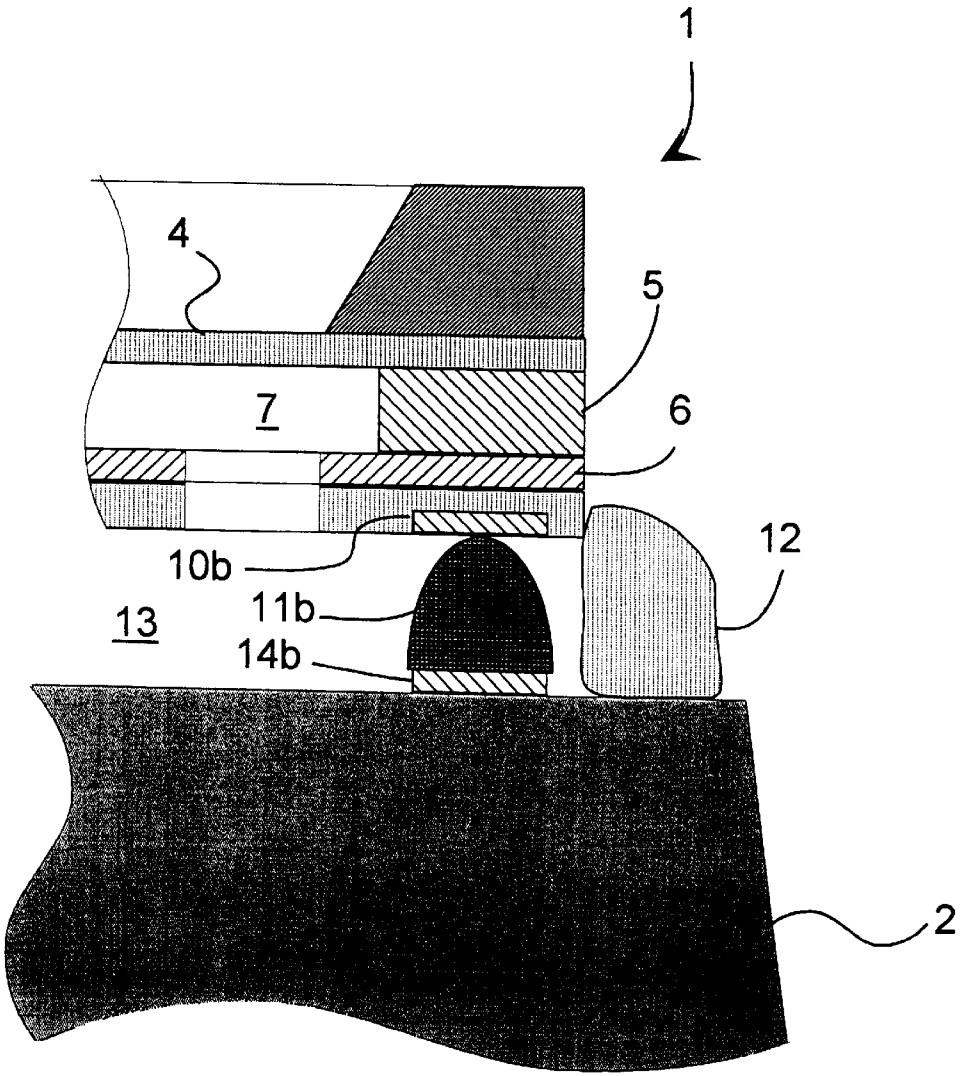
Figure 3C:
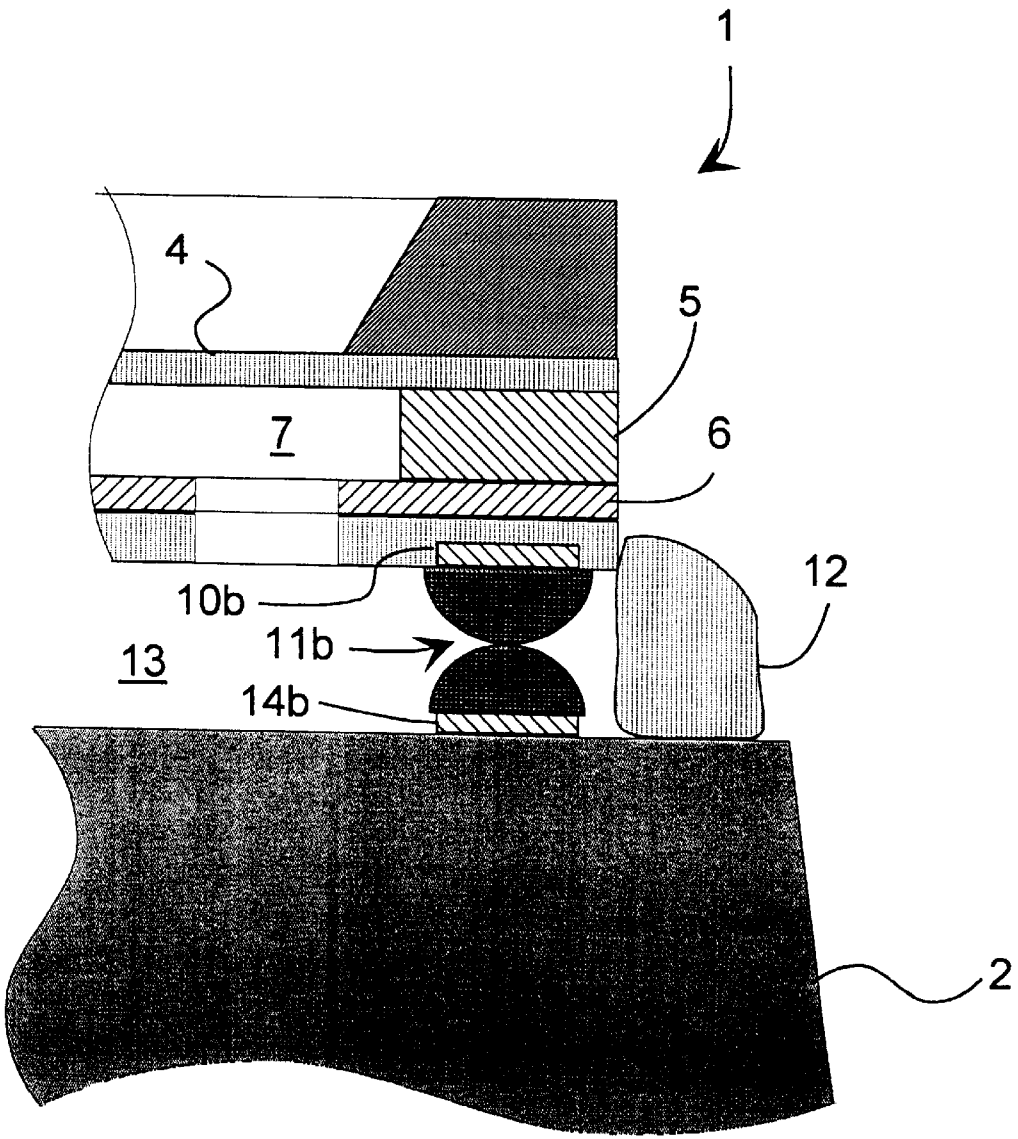
Figure 4:
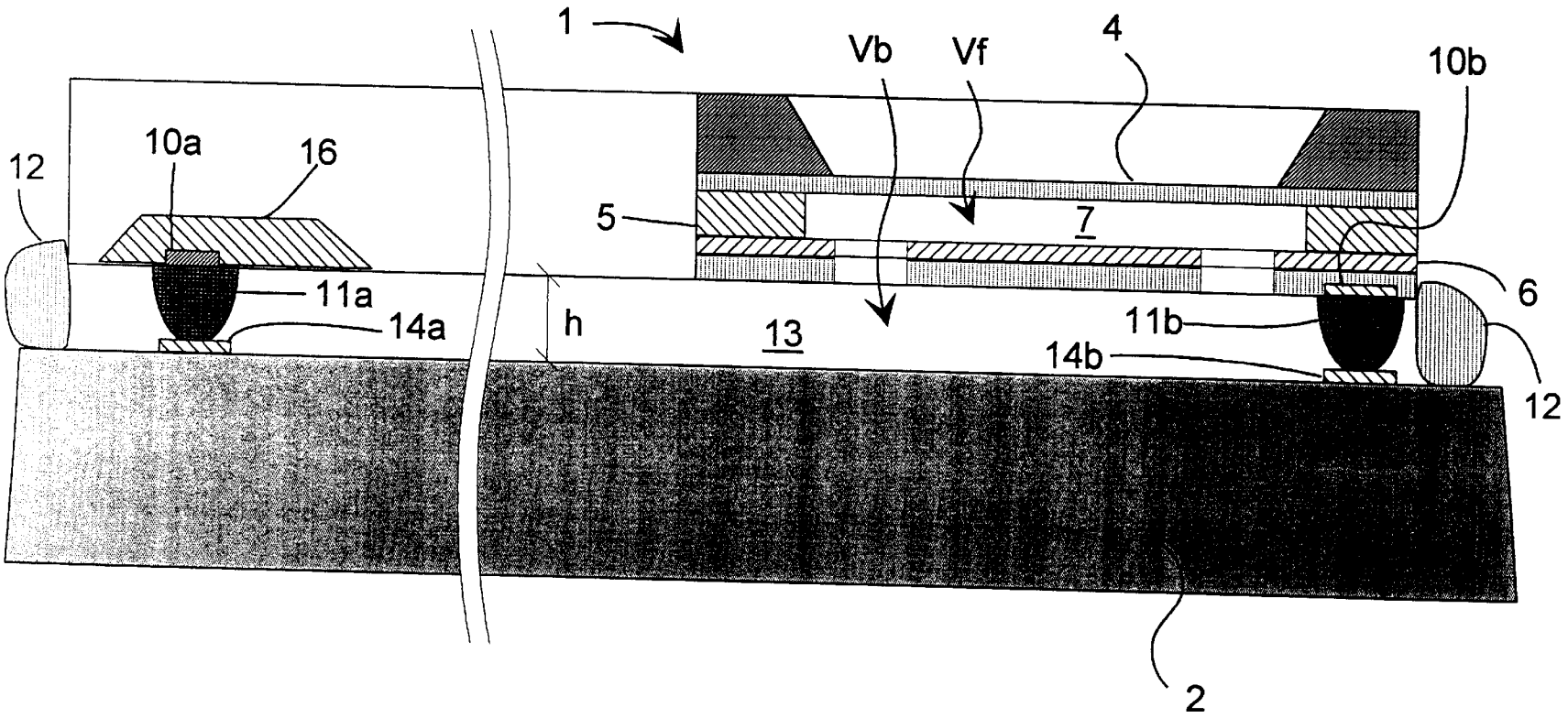

In the following, the invention will be described in more detail with reference to the appended figures, in which FIG. 1 shows a micromechanical microphone of prior art in a reduced cross-section, FIG. 2 shows an attachment of a micromechanical microphone according to a preferred embodiment of the invention in a reduced cross-section, FIGS. 3*a*–3*c* show in more detail some advantageous attachment solutions of a micromechanical microphone according to the invention in a reduced cross-section, and FIG. 4 shows the structure of a micromechanical microphone according to a second preferred embodiment of the invention in a reduced cross-section.

DETAILED DESCRIPTION OF THE PREFERRED EMBODIMENT

The structures of the micromechanical microphones according to the preferred embodiments of the invention, presented in the appended figures, are intended solely for describing the implementation principles of the invention, and therefore the dimensions of the figures do not necessarily correspond to practical applications.

FIG. 2 presents a micromechanical microphone 1 according to a preferred embodiment of the invention, arranged in connection with a housing 15 of a wireless communication device, e.g. a mobile station or a cordless telephone, and attached to a substrate 2, such as an application specific integrated circuit (ASIC). This substrate 2 can also be another mounting suitable for the purpose. This substrate 2, in turn, is attached to a circuit board 3 in a way known as such. The microphone 1 comprises a diaphragm 4, which is at least partly formed to be electrically conductive. The diaphragm 4 is separated from a back electrode 6 with an intermediate layer 5, wherein an air gap 7 is left between the diaphragm 4 and the back electrode 6, which makes the movement of the diaphragm 4 possible due to pressure fluctuations. The back electrode 6 is preferably suitable perforated for each application. FIG. 2 presents two such pressure balancing openings 8*a*, 8*b*, but in practical applications there can be a considerably larger number of these openings, or merely one opening. The diaphragm 4 can also contain one or more pressure balancing openings 9, or pressure balancing is arranged in another way, but this too is not significant with respect to applying the invention. Hereinbelow, the volume bounded by the diaphragm 4, the back electrode 6, and the intermediate layer 5 will be called air gap volume, and marked with the reference Vf.

The back electrode 6 is also at least partly formed to be electrically conductive. Such a microphone structure is typically a so-called capacitor microphone, or if the back electrode or the diaphragm is electrically charged, the term "electret microphone" is also used for this microphone type. The pressure fluctuations caused by a sound are transmitted to the diaphragm 4, wherein the distance between the diaphragm 4 and the back electrode 6 varies as a result of the pressure fluctuations caused by the sound. This change in the distance is electrically detectable in a way known as such. The microphone 1 is attached to the substrate 2 with a so-called flip-chip technology. From the diaphragm 4, an electrically conductive coupling is established to the connector pin 10*a* of the diaphragm, and correspondingly, an electrically conductive coupling is formed from the back electrode 6 to the connector pin 10*b* of the back electrode. These connector pins 10*a*, 10*b* are provided with fixing means 11*a*, 11*b* such as tabs of metal or plastic, balls, or the like, i.e. so-called bump contacts. By means of these fixing means 11*a*, 11*b*, an electrical coupling is provided to the receptable means 14*a*, 14*b* formed on the substrate 2 of the microphone 1, from which the microphone signals can be conducted further to be amplified and processed. In the mounting phase, an electrically conductive glue layer is advantageously formed on the surface of the fixing means 11*a*, 11*b*, which glue layer is used in the attachment to the substrate 2. In the attachment, it is also possible to use other attaching methods of prior art, whereby an electrically conductive connection can be achieved between the fixing means 11*a*, 11*b* and the receptable means 14*a*, 14*b* on the attachment substrate 2.

Furthermore, between the microphone 1 and the substrate 2 there is preferably a non-conductive insulation ring 12. The height of this insulation ring 12 is advantageously arranged to be slightly greater than the distance h between the microphone 1 and the substrate 2. Thus, when the microphone 1 is fixed in its place on the substrate 2, a back chamber 13 is formed in the volume bounded by the microphone 1, the substrate 2, and the insulation ring 12. The volume of this back chamber 13, i.e. a so-called back volume Vb, can be adjusted as desired. This is achieved by forming the height of the fixing means 11*a*, 11*b* in the direction perpendicular to the substrate 2 to be such that when fixed in its place, the distance h between the microphone 1 and the substrate 2 is the desired one. In practical applications, this means typically that the height of the fixing means 11*a*, 11*b* in said direction is substantially the same as the height h desired in the back chamber 13. The back volume Vb is typically at least one order of magnitude larger than the air gap volume Vf left between the diaphragm 4 and the back electrode 6. Thus, when the diaphragm 4 moves, the air between the diaphragm 4 and the back electrode 6 is allowed to flow to the back chamber 13 without causing a significant increase in the pressure in the back chamber 13. The insulation ring 12 functions as a pressure barrier in between the back chamber 13 and the surrounding air.

The insulation ring 12 is advantageously produced of a non-conductive polymer. For example silicone is well suited for this purpose. Silicone is sufficiently elastic to prevent the thermal stress states of the substrate 2 from being transferred to the microphone 1 itself. Furthermore, the insulation ring 12 is used to prevent fillers, solders and other corresponding substances from entering the back chamber 13 at the assembling and soldering stages of the device, and to give rigidness to the attachment between the microphone 1 and the substrate 2 and to increase the reliability of the device in which the microphone 1 according to the invention is applied.

To minimize electrical interference it is also possible to use an electrically conductive material as the material for manufacturing the insulation ring 12, but in that case one has to ensure that the insulation ring 12 does not short circuit the fixing means 11*a*, 11*b*, the connector pins 10*a*, 10*b*, or the receptable means 14*a*, 14*b*. It is also obvious that the insulation ring does not have to be ring-shaped in the direction of the main plane of the substrate, but it is also possible to use other shapes, for example a rectangular shape.

In the microphone 1 according to the invention, it is also possible to integrate a FET transistor, by means of which the electrical signal generated by the microphone is amplified, and at the same time the output impedance of the microphone can be matched.

The use of an application specific integrated circuit (ASIC) as the substrate 2 was mentioned above. Consequently, at least some of the processing functions of the microphone signal can be advantageously implemented in connection with this ASIC circuit. As an example, FIG. 4 presents in a reduced cross-section the structure of such a micromechanical microphone 1 according to a preferred embodiment of the invention. In this embodiment, the same semiconductor chip, such as a silicon wafer, is used to implement the microphone 1 and the processing circuits of the microphone signals. Thus, it is possible to raise the integration level and reduce the size of the end product, such as a mobile station. In FIG. 4, these processing circuits are represented in a reduced manner by arrea 16, but the more detailed implementation of these processing circuits is obvious for anyone skilled in the art. If necessary, it is possible to implement the amplification and the analog/digital conversion of microphone signals in the vicinity of the micromechanical microphone 1 according to the invention, wherein the connection leads can be short and it is possible to decrease the quantity of external interference in the microphone signal. In processing circuits, it is possible to take into account possible signal distortions due to changes in temperature, and on the other hand, corrections can be made in the signal, for instance on the basis of the response characteristic of the microphone.

As the substrate, it is also possible to use an integrated circuit other than said ASIC circuit, for example an analog amplifier circuit. Also other materials are possible, such as glass, ceramic, or the circuit board 3 of the device.

In the above presented example, flip-chip technology is used, wherein the connector pins 10*a*, 10*b* of the processing circuits and the microphone are located on the surface situated on the substrate 2 side.

It is also possible to apply the invention in such a way that the connector pins 10*a*, 10*b* of the processing circuits and possibly also those of the micromechanical microphone 1 are formed on the surface of the semiconductor chip opposite to the substrate 2, wherein electrical couplings are formed with separate connection leads (wire bonding technique).

According to the invention, it is possible to handle the micromechanical microphone 1 fixed on a substrate 2 like a conventional component in connection with transportation, storage, and mounting. By using a microphone 1 according to the preferred embodiment of the invention, which is for example attached to an ASIC circuit, the storing and handling of a separate microphone is eliminated, which reduces the manufacturing costs of the electronic device.

Furthermore, FIG. 2 shows the part in the housing 15 of the electronic device which forms a protective casing for the micromechanical microphone 1 according to a preferred embodiment of the invention. The circuit board 3 of the electronic device is placed in the housing 15 of the electronic device, wherein the walls 15*a*, 15*b*, 15*c* of the housing surround the micromechanical microphone 1 and protect it mechanically. The boundary area between the ends of the side plates 15*a*, 15*b* and the circuit board is advantageously sealed to be air- and dust-proof.

FIGS. 3*a*–3*c* present some examples of the fixing means 11*a*, 11*b* in more detail. It is possible to form the fixing means 11*a*, 11*b* either in the microphone part (FIG. 3*a*), on the substrate 2 (FIG. 3*b*) or in both of them (FIG. 3*c*). It is also obvious that there can be more than two fixing means 11*a*, 11*b*. The number of the fixing means 11*a*, 11*b* is affected for instance by the extent of the integration level of the microphone, and by whether said FET transistor, A/D converter etc is implemented as a part the microphone 1 or not. Furthermore, at least some, or even all the fixing means 11*a*, 11*b*, can in some applications be located outside the insulation ring 12. Also in that case the height of the fixing means 11*a*, 11*b* can be used to adjust the back volume Vb, as described above in this specification.

As for the typical dimensions of the micromechanical microphone 1 according to the invention in practical applications, it can be mentioned that the diameter of the microphone 1 is in the order of 1.5 to 3 mm. It is obvious that in applications in which also other electric circuits are integrated with the microphone 1 in the same semiconductor chip, this semiconductor chip can also be considerably larger in size. The thickness of the diaphragm 4 is approximately 1 $\mu$m, and the diameter approximately from 0.5 to 1 mm. The thickness of the back electrode 6 is in the order of 1 to 5 $\mu$m. The thickness of the air gap 7 is also in the order of micrometers, wherein the height of the back chamber 13 is advantageously between 5 and 500 $\mu$m. The capacitance of the micromechanical microphone 1 according to the invention is usually approximately from 7 to 8 pF.

To shield the micromechanical microphone 1 electrically, for example against high frequency signals, it is possible to couple the diaphragm 4 to the ground potential and to use the back electrode 6 as an output connection for the microphone signal. Furthermore, it is possible to provide the circuit board 3 with metallized sections or other corresponding shields. The housing 15 of the electronic device can also be used as an RF shield, by coating the inner surface of the walls 15*a*, 15*b*, 15*c* of the housing surrounding the microphone advantageously with an electrically conductive substance, or by producing the housing 15 of plastic which is treated to be electrically conductive. When designing the shieldings, however, one has to take into account the capacitance which the shielding procedures possibly create and which can affect the electrical function of the microphone 1.

The present invention is nor restricted solely to the embodiments presented above, but can be modified within the scope of the appended claims.

What is claimed is:

1. A method for attaching a micromechanical microphone (1) used in connection with a mobile station to a substrate (2), in which a diaphragm (4) and a back electrode (6) for the microphone (1) are placed within a distance from each other, wherein an air gap (7) is formed between the diaphragm (4) and the back electrode (6), characterized in that an insulation ring (12) is placed between the microphone (1) and the substrate, wherein the back electrode (6), the substrate (2) and the insulation ring (12) define a back chamber (13), and that the microphone (1) is attached to the substrate (2) with fixing means (11*a*, 11*b*), wherein the volume (Vb) of the back chamber (13) is adjusted by adjusting the height of the fixing means (11*a*, 11*b*).

2. The method according to claim 1, characterized in that the micromechanical microphone (1) is produced on a semiconductor wafer, such as a silicon wafer.

3. The method according to claim 1, characterized in that an integrated circuit, such as an ASIC circuit is used as the substrate.

4. The method according to claim 2, characterized in that at least some of the circuits intended for processing of a microphone signal generated in the microphone (1) are integrated in the semiconductor wafer to be used in the fabrication of the micromechanical microphone (1).

5. A micromechanical microphone (1) for a wireless communication device, which is arranged to be attached to a substrate (2) and comprises a diaphragm (4) and a back electrode (6), placed within a distance from each other, wherein an air gap (7) is formed between them, characterized in that an insulation ring (12) is arranged to be placed between the microphone (1) and the substrate, wherein the back electrode (6), the substrate (2) and the insulation ring (12) define a back chamber (13), and that the microphone is arranged to be attached with fixing means, wherein the volume (Vb) of the back chamber (13) is arranged to be adjusted by adjusting the height of the fixing means (11*a*, 11*b*).

6. The micromechanical microphone (1) according to claim 5, characterized in that the insulation ring (12) is of polymer, such as silicone.

7. The micromechanical microphone (1) according to claim 5, characterized in that the height of the back chamber (13) is between 20 and 500 $\mu$m.

8. The micromechanical microphone (1) according to claim 5, characterized in that it is produced primarily of silicon compounds.

9. The micromechanical microphone (1) according to claim 5, characterized in that the substrate (2) is an integrated circuit, such as an ASIC circuit.

10. The micromechanical microphone (1) according to claim 5, characterized in that the fixing means (11*a*, 11*b*) are formed of metal flip-chips.

* * * * *